United States Patent [19]

Amir

[11] Patent Number: 4,815,296

[45] Date of Patent: Mar. 28, 1989

[54] HEAT EXCHANGER FOR CONDENSING VAPOR CONTAINING NON-CONDENSABLE GASES

[75] Inventor: Nadav Amir, Yavne, Israel

[73] Assignee: Ormat Turbines (1965), Ltd., Yavne, Israel

[21] Appl. No.: 167,919

[22] Filed: Mar. 14, 1988

[51] Int. Cl.[4] ..... F01K 25/08

[52] U.S. Cl. ..... 60/651; 60/671; 60/692; 165/111

[58] Field of Search ..... 165/11; 60/651, 671, 60/690, 692

[56] References Cited

U.S. PATENT DOCUMENTS

| | | | |
|---|---|---|---|
| 3,556,204 | 1/1979 | Dehne | 165/111 |
| 4,177,859 | 12/1979 | Gatti et al. | 165/113 |
| 4,190,102 | 2/1980 | Gerz | 165/113 |
| 4,471,621 | 9/1984 | Anir et al. | 60/671 |

*Primary Examiner*—Allen M. Ostrager
*Attorney, Agent, or Firm*—Sandler & Greenblum

[57] ABSTRACT

A heat exchanger for condensing a vapor containing non-condensable gases comprises an inlet header for receiving said vapor and non-condensable gases, and a plurality of heat exchanger tubes arranged in a plurality of vertically spaced banks. One end of each tube is connected to the inlet header for receiving the vapor and the non-condensable gases in parallel; and the other end of each tube in a bank is connected to a separate header associated with each bank. Each separate header is vented for venting non-condensable gases therein to the atmosphere. The provision of separate headers for each bank of tubes prevents equalization of pressure between the banks thereby preventing back-flow and the creation of pockets of non-condensable gases in the tubes of a bank. Where the banks of tubes are inclined to the horizontal, and the separate headers are elevated above the inlet header, the non-condensable gases in a bank, flow rapidly upwardly into the separate header with which the bank is associated, particularly when the gases are lighter than the vapor. This permits the non-condensable gases to be vented easily as the condensate flows downwardly into the inlet header.

20 Claims, 1 Drawing Sheet

HEAT EXCHANGER FOR CONDENSING VAPOR CONTAINING NON-CONDENSABLE GASES

TECHNICAL FIELD

This invention relates to an improved heat exchanger for condensing a vapor containing non-condensable gases, to a method for using such a heat exchanger, and to a power plant that uses such a heat exchanger.

BACKGROUND ART

Many industrial applications require heat exchangers to condense or cool vapor containing non-condensable gases. Examples of such applications are condensers for power plants, particularly power plants using organic working fluids, coolers in oil refineries, etc. In each case, the venting of the non-condensable gases is important in order to prevent build-up of these gases on heat exchanger surfaces, a situation that adversely affects the transfer of heat through the affected surfaces.

Where the heat exchanger is air-cooled, and is of the type having a plurality of heat exchanger tubes organized into a plurality of vertically spaced banks of tubes connected to an inlet header that receives the vapor and non-condensable gases (hereinafter referred to as a heat exchanger of the type described), the temperature of the air that cools the tubes increases as the air passes around the tubes and through successive banks. Generally, the air flows vertically upwardly so that the coolest air is in contact with the lowermost bank of tubes, and the warmest air is in contact with the uppermost bank. Thus, the temperature and pressure inside each bank of tubes will be different; and disturbances in the flow of vapor and liquid condensate have been found to occur, particularly when the vapor being condensed is heavier than the non-condensable gases contained in the vapor. Such disturbances adversely affect the operational characteristics of the condensers and often erratically affect the efficiency of the heat exchanger.

In condensers for Rankine cycle power plants utilizing organic working fluids, it is conventional to provide a heat exchanger of the type described wherein one or more banks of tubes are inclined relative to the horizontal, one end of each of the tubes being connected to an inlet header, and the other end of each of the tubes being connected to a collection header located at an elevation above the inlet header. In this manner, the vapor in each bank flows upwardly in the tubes thereof in contact with the upper, interior portion of each tube, and the condensate, produced by the exchange of heat between the vapor and the air outside the tube, flows, downwardly in contact with the lower, interior portion of each tube. Non-condensable gases in the vapor admitted into the condenser, being lighter than the vaporized organic working fluid at the same temperature and pressure, collect at the top of the collection header which is located at the highest point in the system. These non-condensables can be vented from the collection header; but the differences in pressure in each bank appear to interfere with the flow of the non-condensables with the result that not all of the non-condensables are vented and some are drawn back into the system or adversely affect the heat transfer characteristics of the condenser.

An object of the present invention is to provide a new and improved heat exchanger which overcomes the above-described deficiencies of prior art heat exchangers of the type described.

DISCLOSURE OF INVENTION

A heat exchanger according to the present invention for condensing a vapor containing non-condensable gases comprises an inlet header for receiving said vapor and non-condensable gases, and a plurality of heat exchanger tubes arranged in a plurality of vertically spaced banks. One end of each tube is connected to the inlet header for receiving the vapor and the non-condensable gases in parallel; and the other end of each tube in a bank is connected to a separate header associated with each bank. Vent means are provided in each separate header for venting non-condensable gases therein to the atmosphere. Preferably, the banks of tubes are inclined to the horizontal and the separate headers are elevated above the inlet header.

The provision of separate headers for each bank of tubes prevents equalization of pressure between the banks thereby preventing back-flow and the creation of pockets of non-condensable gases in the tubes of a bank. Where the banks of tubes are inclined to the horizontal, and the separate headers are elevated above the inlet header, the non-condensable gases in a bank, flow rapidly upwardly into the separate header with which the bank is associated, particularly when the the gases are lighter than the vapor. This permits the non-condensable gases to be vented easily as the condensate flows downwardly into the inlet header.

When the tube are air cooled, enhancing means may be provided for enhancing the transfer of heat between the air outside the tubes and the vapor and non-condensable gases inside. The enhancing means may include fins on the exterior of said tubes, and/or blower means for blowing air over said tubes, preferably in a upwardly direction starting from below the tubes of the lowermost bank of tubes.

Preferably, the inlet header is vertically oriented and the banks are connected at vertically displaced positions. Alternatively, or in addition, the separate headers are stacked one on top of the other, and are constituted by an outer shell and inner dividers.

The invention also consists in a power plant comprising a boiler for evaporating liquid working fluid and producing vaporized working fluid, a turbogenerator responsive to the vaporized working fluid for producing power and heat depleted vaporized working fluid, and a condenser responsive to said heat depleted vaporized working fluid for condensing the same and producing condensed working fluid that is returned to the boiler. The condenser has an inlet header for receiving the heat depleted working fluid and any non-condensable gases therein, a plurality of heat exchanger tubes inclined to the horizontal and arranged in a plurality of vertically spaced banks, and a separate header associated with each bank. One end of each tube is connected to the inlet header for receiving the heat depleted working fluid (vapor and non-condensable gases) in parallel, and the other end of each tube in a bank is connected to the separate header with which the bank is associated. Vent means are provided in each separate header for vening non-condensable gases therein to the atmosphere.

Finally, the invention consists in a method for separating non-condensable gases from a vaporized working fluid. The method comprises applying the vaporized working fluid and the non-condensable gases to an inlet header to which are connected a plurality of heat exchanger tubes inclined to the horizontal and arranged in a plurality of vertically spaced banks, one end of each tube being connected to the inlet header for receiving said vapor and said non-condensable gases in parallel. The method according to the present invention also includes connecting the other end of each tube in a bank to a separate header associated with each bank, and venting each separate header to the atmosphere.

BRIEF DESCRIPTION OF DRAWINGS

An embodiment of the present invention is shown in the accompanying drawings wherein.

DETAILED DESCRIPTION

Figure 1:
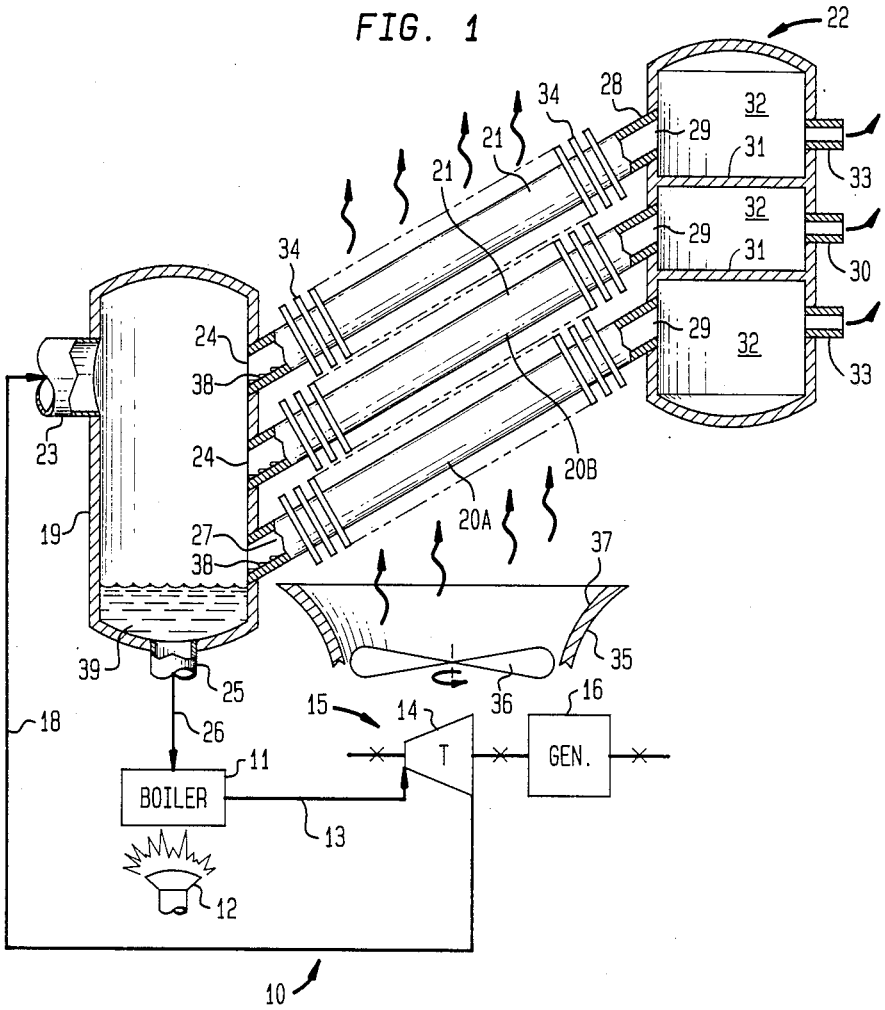
FIG. 1 is a schematic representation of the present invention showing an organic fluid Rankine cycle power plant and a side view, partially in section, of a condenser according to the present invention.

Turning now to FIG. 1 of the drawing, reference numeral 10 designates a Rankine cycle power plant operating with an organic fluid such as a Freon or the like. Power plant 10 comprises boiler 11 containing liquid working fluid which is heated by an outside source shown schematically at 12 for producing vaporized working fluid that is transferred via pipe 13 to the inlet nozzles (not shown) of turbine 14 of turbogenerator 15 that includes generator 16 driven by turbine 14. In response to the expansion of vaporized working fluid in turbine 14, generator 16 delivers power to a load (not shown), and the turbine produces heat depleted working fluid that is delivered to condenser 17 by conduit 18. As described below, the heat depleted working fluid is condensed in condenser 17, and the condensate is returned, either by gravity, or by pump, to boiler 11, and the cycle repeats.

Figure 2:
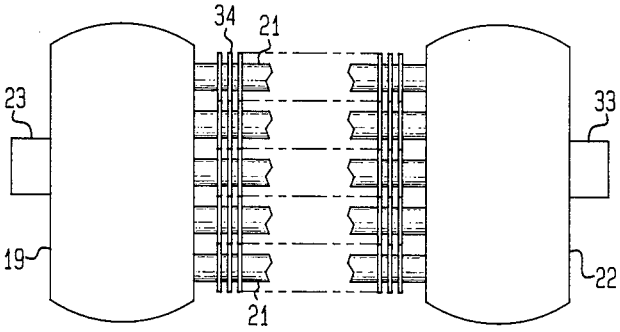
FIG. 2 is a top plan view of the condenser in FIG. 1.

Condenser 17 is constructed in accordance with the present invention and includes inlet header 19, a plurality of banks 20A, 20B, . . . of heat exchange tubes 21, and upper header 22. Header 19 includes inlet connection 23 to which conduit 18 is attached thereby affecting entry into the header of vaporized heat depleted working fluid exhausted from the turbine, and of any non-condensables such as air or other gases. Header 19 is elongated in the horizontal direction (see FIG. 2) and contains, in a side thereof opposite the side containing connection 23, a plurality of vapor exit connections 24 arranged in rows and columns. That is to say, connections 24 are horizontally spaced as shown in FIG. 2, and are vertically spaced as shown in FIG. 1, for reception of one end of respective tubes 21. Finally, the bottom of header 19 is provided with liquid exit connection 25 which leads to conduit 26 and conveys the condensate back to boiler 11.

One end 27 of each of tubes 21 is connected to an exit connection 24 in header 19; and the other end 28 of each of the tubes is connected to an input connection 29 of upper header 22 which is in the form of outer shell 30 that includes a plurality of inner dividers 31 that divide the shell into a plurality of separate chambers 32. The number of chambers is the same as the number of banks of tubes. Thus, FIG. 1 of the drawing shows three vertically spaced banks; and in such case, three chambers 32 are formed in upper header 22. Fewer or more than three banks can be used depending on the design characteristics of the condenser. Finally, each chamber 32 is vented by an exit orifice 33.

As shown in the drawing, the condenser is air-cooled and enhancing means are provided for enhancing the transfer of heat from the vapor inside tubes 21. The enhancing means may include fins 34 on the outside of tubes 21 for increasing the heat transfer surface are a of the tubes. Preferably, and in addition, the enhancing means includes blower means 35 located below the banks of tubes. Blower means 35 may include propeller 36 mounted for rotation about a vertical axis and housed in Venturi-like shroud 37 for producing an upward flow of air into the banks of tubes. As a result, air flows upwardly around the individual tubes and through the successive banks of tubes cooling the vapor contained therein.

In operation, heat depleted working fluid and non-condensables enter inlet header 19 through connection 23. All of the exit connections 24 are accessible to the interior of the header; and as a consequence, vapor and non-condensables are applied in parallel to banks of tubes 20A, 20B, . . . The vapor and noncondensables flow into the various tubes where the vapor is cooled by the air flowing outside the tubes and condensation takes place. The condensate collects inside the tubes and runs downwardly towards header 19 as indicated schematically by drops 38 which collect in lower sump 39 of the header. Lighter non-condensables rise in the tubes and enter separate chambers 32 according to the bank of tubes involved. Each of these chambers is separately vented at 33 allowing the non-condensables to be vented from the system.

Note that the separate nature of chambers 32 precludes pressure equalization between the banks and allows each bank to reach an equilibrium temperature and pressure distribution along the tubes thereof independently of the distribution in any of the other banks. Furthermore, since the banks are inclined to the horizontal and chambers 32 are elevated above inlet header 19, separation of the condensing vapors from the lighter non-condensable gases and the venting of these gases are facilitated as the light non-condensable gases flow rapidly upwardly and accumulate in chambers 32 associated with each bank where they are vented, while the liquid condensate produced flows downwardly towards inlet header 19 and collects in lower sump 39 of the header. While the drawing illustrates a forced draft condenser arrangement, the invention is also applicalbe to natural draft cooling arrangements. Generally the decision to go with forced or natural draft cooling depends on the size of the power plant involved. For example, in the low power range of 400–2000 watts, natural draft is mostly used; while in higher power ranges, typically 300–1000 KWatts, forced draft condenser cooling is likely to be used. Furthermore, the invention is applicable to other types of heat exchangers, and is particularly useful in connection with hydrocarbon coolers used in pertroleum refineries.

The advantages and improved results achieved by the method and apparatus of the present invention are apparent from the foregoing description of the preferred embodiment of the invention. Various changes and modifications may be made without departing from the scope of the invention as described in the claims that follow.

I claim:

1. A heat exchanger for condensing a vapor containing non-condensable gases comprising:

(a) an inlet header for receiving said vapor and non-condensable gases;

(b) a plurality of heat exchanger tubes arranged in a plurality of vertically spaced banks, one end of each tube being connected to the inlet header for receiving said vapor and said non-condensable gases in parallel;

(c) a separate header associated with each bank, the other end of each tube in a bank being connected to the separate header with which the bank is associated; and (d) vent means in each separate header for venting non-condensable gases therein to the atmosphere.

2. A heat exchanger according to claim 1 wherein said tubes are inclined to the horizontal.

3. A heat exchanger according to claim 2 wherein the separate headers are positioned vertically above the inlet header.

4. A heat exchanger according to claim 3 wherein said heat exchanger tubes are air cooled, and enhancing means are provided for enhancing the transfer of heat betweeen the air outside said tubes and the vapor and non-condensable gases inside.

5. A heat exchanger according to claim 4 wherein said enhancing means includes fins on the exterior of said tubes.

6. A heat exchanger according to claim 4 wherein said enhancing means includes blower means for blowing air over said tubes.

7. A heat exchanger according to claim 6 wherein said blower means blows air upwardly from below said tubes through said banks of tubes.

8. A heat exchanger according to claim 7 wherein said tubes are finned.

9. A heat exchanger according to claim 8 wherein said vapor is an organic fluid.

10. A heat exchanger according to claim 8 wherein said inlet header is vertically oriented and said banks are connected at vertically displaced positions.

11. A heat exchanger according to claim 10 wherein said separate headers are stacked one on top of the other.

12. A heat exchanger according to claim 11 wherein said separate headers are constituted by an outer shell and inner dividers.

13. A power plant comprising:

(a) a boiler for evaporating liquid working fluid and producing vaporized working fluid;

(b) a turbogenerator responsive to said vaporized working fluid for producing power and heat depleted vaporized working fluid; and (c) a condenser responsive to said heat depleted vaporized working fluid for condensing the same and producing condensed working fluid that is returned to the boiler;

(d) said condenser having an inlet header for receiving said vapor and any non-condensable gases therein, a plurality of heat exchanger tubes inclined to the horizontal and arranged in a plurality of vertically spaced banks, one end of each tube being connected to the inlet header for receiving said vapor and said non-condensable gases in parallel, a separate header associated with each bank, the other end of each tube in a bank being connected to the separate header with which the banks is associated, and vent means in each separate header for venting non-condensable gases therein to the atmosphere.

14. A power plant according to claim 13 said heat exchanger tubes are air cooled, and enhancing means are provided for enhancing the transfer of heat between the air outside said tubes and the vapor and non-condensable gases inside.

15. A power plant according to claim 14 wherein said enhancing means includes fins on the exterior of said tubes.

16. A power plant according to claim 14 wherein said enhancing means includes blower means for blowing air over said tubes.

17. A power plant according to claim 16 wherein said blower means blows air upwardly from below said tubes through said banks of tubes.

18. A power plant according to claim 17 wherein said tubes are finned.

19. A power plant according to claim 17 wherein said working fluid is an organic fluid.

20. A method for separating non-condensable gases from a vaporized working fluid comprising the steps of:

(a) applying the vaporized working fluid and the non-condensable gases to an inlet header to which are connected a plurality of heat exchanger tubes inclined to the horizontal and arranged in a plurality of vertically spaced banks, one end of each tube being connected to the inlet header for receiving said vapor and said non-condensable gases in parallel;

(b) connecting the other end of each tube in a bank to a separate header associated with each bank; and (c) venting each separate header to the atmosphere.

* * * * *